United States Patent [19]

Wyckoff et al.

[11] 4,192,626

[45] Mar. 11, 1980

[54] MACHINE FOR APPLYING A UNIFORM PRESSURE

[75] Inventors: Frank K. Wyckoff; Roger C. Silver, both of Des Moines, Iowa

[73] Assignee: Atlas Products, Inc., Des Moines, Iowa

[21] Appl. No.: 969,944

[22] Filed: Dec. 15, 1978

[51] Int. Cl.[2] ..... E01C 19/26

[52] U.S. Cl. ..... 404/123; 172/551; 180/19 S; 301/132; 280/112 A; 280/696; 280/701

[58] Field of Search ..... 404/122, 125, 124, 123, 404/132, 117; 172/518, 554, 551; 180/20, 19 R, 19 S, DIG. 2; 305/30; 301/109, 110, 132; 280/80 R, 106.5 R, 112 A, 126, 696, 701, 787, 788

[56] References Cited

U.S. PATENT DOCUMENTS

| | | | |
|---|---|---|---|
| 53,848 | 4/1866 | McClure | 172/551 |
| 386,220 | 7/1888 | Riebold | 404/122 |
| 539,615 | 5/1895 | Figge | 172/554 X |
| 639,829 | 12/1899 | Schaffer | 404/125 X |
| 718,870 | 1/1903 | Packer | 404/125 |
| 976,293 | 11/1910 | Reiff | 404/122 |
| 2,382,986 | 8/1945 | Ganley | 404/123 |
| 2,751,959 | 6/1956 | Blomquist | 404/124 |
| 2,805,868 | 9/1957 | Madden | 280/701 |
| 3,422,735 | 1/1969 | Vitry | 404/123 X |

*Primary Examiner*—Nile C. Byers, Jr.

*Attorney, Agent, or Firm*—Rudolph L. Lowell; G. Brian Pingel

[57] ABSTRACT

A machine for uniformly applying a pressure on a relatively flat surface includes a portable frame structure and at least one frame supporting roller rotatably mounted on an axle by a pair of spaced journal assemblies. Each journal assembly has an upright bracket member with a top end secured to the underside of the frame structure, and an upright guideway in which the body portion of a bearing member, for rotatably supporting one end of the roller axle, is guidably movable. Flanges laterally extended from opposite sides of each bearing body portion are positioned between an associated bracket member and adjacent side of the roller. Each flange is formed with a fulcrum portion that is in contact engagement with the adjacent side surface of an associated bracket member for pivotal movement of the bearing member in response to a lateral tilting movement of the roller. Coil springs normally oppose upward movement of the bearing members, but are compressible upon pivotal movement of the bearing members to insure maximum surface contact between the roller and the flat surface when a surface irregularity is encountered by the rollers.

4 Claims, 6 Drawing Figures

MACHINE FOR APPLYING A UNIFORM PRESSURE

BACKGROUND OF THE INVENTION

1. Field of the Invention

The present invention relates in general to machines for applying pressure on a relatively level surface, and more specifically to such machines for uniformly applying pressure on a laminate material for adhesive securement to a relatively level surface, wherein the machine has a plurality of relatively movable tiltable rollers arranged in a staggered relation with overlapping areas to provide a uniform pressure application on the laminate transversely of the machine.

2. Description of the Prior Art

For over three decades it has been known in the road roller art to support a weight bearing frame by a plurality of rollers that have surface areas in an overlapping surface contact with a road surface on which the rollers travel, as illustrated by U.S. Patent to Ganley No. 2,382,986.

The Ganley patent discloses a road roller device having a weight bearing frame supported by five rollers that are in a fixed relation with the frame. Thus, the rollers of the Ganley device are not tiltable with their axles. Consequently, if the road surface on which a roller travels has a surface irregularity such that one side of the roller encounters a surface area lower than the other side of the roller, contact between the lower surface and the roller will be reduced or avoided. Roller systems, as exemplified by Ganley, are thus ineffective to maintain a continuous substantially uniform surface contact between a plurality of frame supported rollers and the surface area on which the rollers travel.

SUMMARY OF THE INVENTION

The present invention provides a machine that applies pressure on a relatively level surface and has a weight bearing frame structure supported by rotatably mounted rollers that have tiltable axles to insure maximum surface contact between the rollers and the surface being traversed. The rollers are mounted from the bottom of the frame structure by journal means each of which includes a pair of upright spaced bracket means having vertical guideways for bearing means which support the ends of a roller axle.

Each of the bearing means has a body portion movable in the guideway of an associated bracket means and includes flange portions positioned between the associated bracket means and the roller. The flange portions are formed with fulcrum portions engagable with the adjacent surface of an associated bracket means for pivotal movement of the bearing means in response to a roller tilting movement. A yieldable pressure means coacts with the bracket means and the bearing means to oppose upward vertical movement of the bearing means within a guideway.

In a preferred embodiment, the machine of the present invention includes a plurality of frame structure supporting rollers arranged transversely of the frame structure in at least two transversely extended rows in which the rollers are relatively staggered. The rollers of each row are in a transversely spaced relation, with the rollers of one row in an overlapping relation with adjacent rollers in the other row for applying pressure uniformly on the surface area within the transverse confines of the roller assembly. As a result, such roller arrangement provides a uniform pressure over the surface being traversed.

DESCRIPTION OF THE PREFERRED EMBODIMENT

Figure 1:
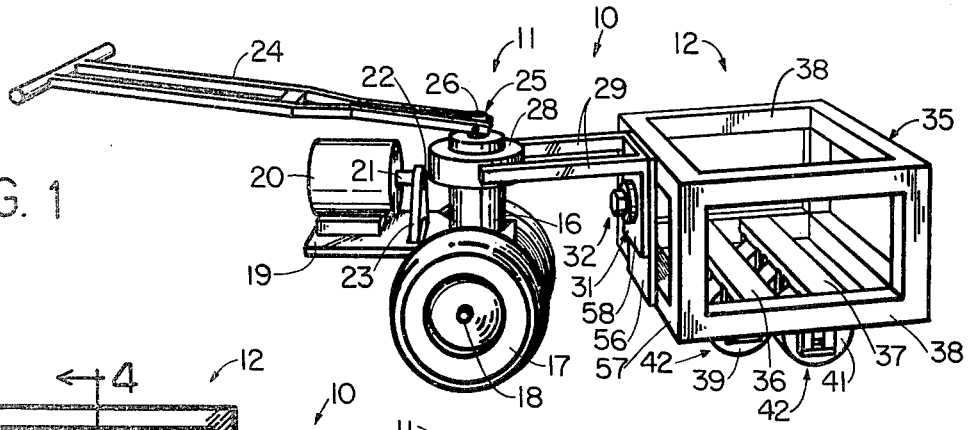
FIG. 1 is a side perspective view of a tractor unit and a pressure applying unit forming a preferred embodiment of the pressure applying machine of the present invention.
Figure 2:
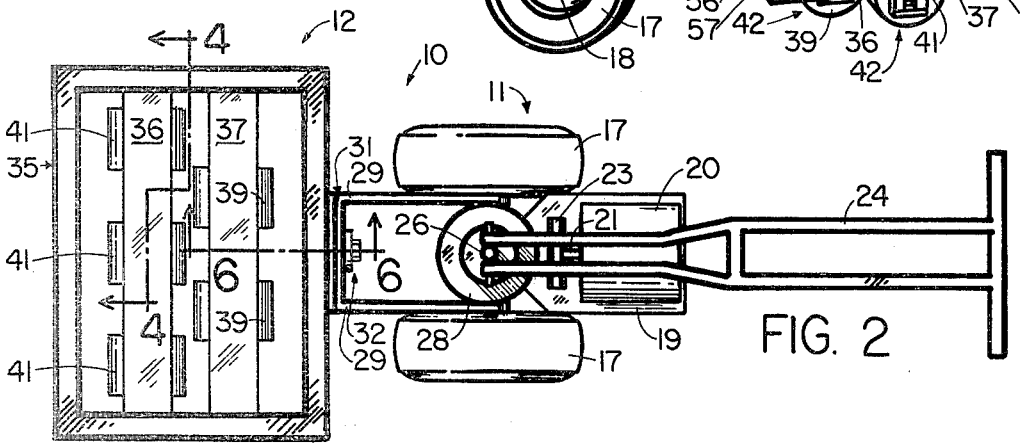
FIG. 2 is a plan view of the machine of FIG. 1.
Figure 7:
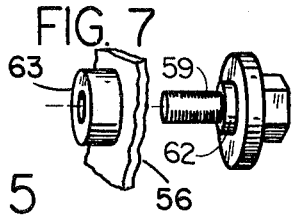
FIG. 7 is an exploded perspective view of a portion of the pivotal connection shown in FIG. 6.

A machine, indicated generally at 10 in FIG. 1, for applying a uniform pressure on a relatively level surface includes a steerable tractor unit 11 and a pressure applying unit 12 moved by the tractor unit. The machine 10 is particularly well suited for applying a selected pressure on a flat laminate material for adhesive securement to a bowling surface, but may also be employed for outdoor purposes as well.

The tractor unit 11 has a cylindrically shaped housing 16 supported on a pair of drive wheels 17 mounted on an axle 18. A horizontal platform 19 extended laterally from the housing 16 supports an electrically driven reversible motor 20, having a drive shaft 21 with a pully 22 for a power transmission belt 23 to form a portion of a drive train for the wheels 17.

A steering handle 24 is connected to the wheel axle 18 by a steering linkage, that includes an upright steering post 25 rotatably supported in the housing 16 with its upper end pivotally connected at 26 to the steering handle 24. A connecting collar 28 rotatably mounted about the steering post 25 below the handle connection 26 is fixed, as by welding, to the free ends of a pair of horizontally extended transversely spaced arms 29 of a hitch bracket 31, that forms part of a coupling assembly 32 for connecting the pressure applying unit 12 to the tractor unit 11. It is seen, therefore, that the steering handle 24 is pivotally mounted about a horizontal axis relative to the steering post 25, and rotatable with the post 25 about a vertical axis relative to the connecting collar 28 for manipulating the drive wheels 17 for steering purposes. It is to be also noted that the tractor unit 11 is pivotally movable relative to the pressure applying unit 12 about a vertical axis.

The pressure applying unit 12 has a box shaped unit 35 for carrying weights, not shown, for support on a pair of transversely extended frame bottom members 36 and 37, that extend between and are secured to frame side sections 38.

Each frame member 36 and 37 functions as a mounting or base plate for carrying rollers 39 and 41, respectively, from the underside of the box unit 35. For convenience of description the rollers 39 on the base plate 36 will hereinafter be referred to as the rear rollers, and the rollers 41 on the base plate 37 as the front rollers. As illustrated there are three front rollers 41 and two rear rollers 39.

The rollers 39 and 41 are spaced transversely of the pressure applying unit 12 with the rear rollers 39 arranged in a staggered relation relative to the front rollers 41 so that the two rollers 39 overlap the spaces between the front rollers 41. Thus, the two sets of rollers 39 and 41 together form a continuous and uniform pressure applying assembly transversely of the box unit 35.

Figure 3:
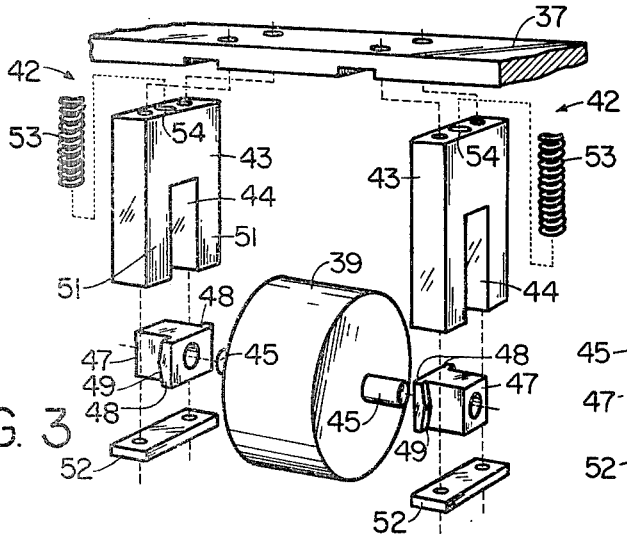
FIG. 3 is an exploded, enlarged perspective view of a support roller and journal means assembly forming part of the machine in FIG. 1.
Figure 5:
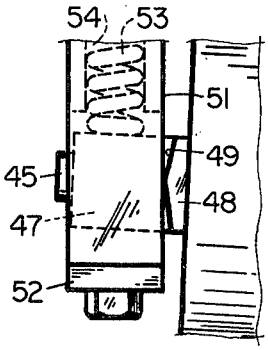
FIG. 5 is an enlarged detail view of one end of a tilted roller axle.

Referring now to FIGS. 3 and 5, each of the rollers 39 and 41 is supported from the underside of an associated mounting member 36 and 37, respectively, by journal units 42 that permit independent, up and down and tilting movements of the rollers 39 and 41. The journal unit 42 for each of the rollers 39 and 41 are of a like construction and include a pair of spaced apart brackets 43 that are of a substantially inverted U-shape. The top or base end of each bracket 43 is secured to a mounting plate 36 or 37. A guideway 44 formed between the leg sections of each bracket member 43 extends upwardly from the bottom of a bracket member 43.

Figure 4:
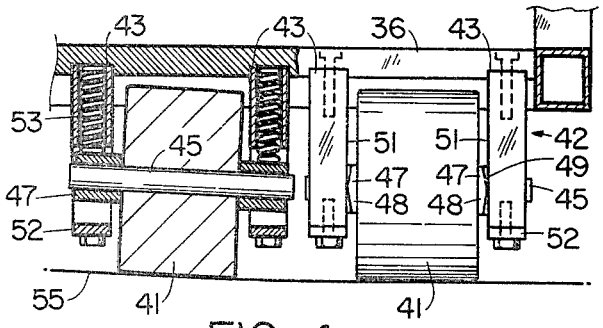
FIG. 4 is an enlarged cross sectional view taken along the line 4—4 in FIG. 2 showing one of the support rollers in a tilted position.

Each of the rollers 39 and 41 has an axle or shaft with axially projected end sections 45 rotatably supported in bearing blocks 47 guidably received in the bracket guideways 44. Each bearing block 47 has a generally cube shaped body member formed at the end thereof adjacent a roller with a pair of transversely opposite laterally projected ears 48. The side of an ear 48 remote from a roller 39 or 41 is of an angulate shape to provide a fulcrum edge 49. With a bearing block 47 guidably received in an associated guideway 44, the ears 48 are positioned between a roller and a bracket member 43, with a fulcrum edge 49 in rideable contact engagement with an adjacent side surface 51 of a leg section of the bracket member 43 (FIGS. 4 and 5). The apices or fulcrum edges 49 thus serve as pivots providing for pivotal movement of a bearing block 47 relative to a bracket member 43 in response to a tilting movement of a roller 39 or 41.

A stop plate 52 is bolted to the bottom end of each bracket member 43 to close the lower end of a guideway 44. Each bracket member 43 also has a yieldable pressure means in the form of a coil spring 53 seated in a bore 54 extended longitudinally axially of a bracket member 43 from the top end thereof to the upper end of a guideway 44. The coil springs 53 are normally in a partially compressed condition between a mounting member 36 or 37 and an associated bearing block 47, and act to yieldably oppose upward movement of the bearing blocks 47. However, as shown in FIGS. 4 and 5, if the surface traveled by the machine 10 is not substantially level, for instance sloped as indicated at 55 in FIG. 4, the springs 53 and fulcrum edges 49 permit a roller 39 or 41 to tilt while maintaining a full surface contact between the roller and the sloped portion 55. As a result, a relatively uniform pressure is applied on the sloped portion 55 and adjacent level surface portions.

Figure 6:
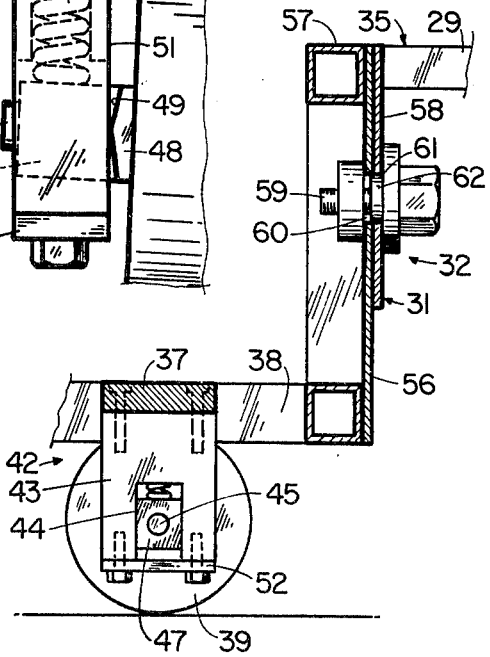
FIG. 6 is an enlarged fragmentary sectional view taken along the line 6—6 of FIG. 2 showing a horizontal pivotal connection between the tractor unit and the pressure applying unit of the machine of FIG. 1.

As previously mentioned the hitch bracket 31 forms part of a coupling assembly 32 that additionally includes a mounting plate 56 secured to front side section 57 of the box unit 35. The bracket 31 is of a right angle shape with the arms 29 projected laterally from a plate section 58 positioned in a back-to-back relation with the front mounting plate 56. A horizontal connecting shaft assembly 59 extended through aligned openings 60 and 61 (FIG. 6) in the front mounting plate 56 and bracket plate section 58, respectively, has a bearing section 62 within the opening 61 to permit relative pivotal movement between the tractor unit 11 and pressure applying unit 12 about the shaft assembly 59. A nut member 63 is fixed to the interior of the backplate 56 in axial alignment with the opening 60 to threadably engage the shaft assembly 59. Thus, the tractor unit 11 is movable independently of the pressure applying unit 12 in response to surface irregularities therebetween. The present invention, thus, provides a pressure applying means that is adapted to apply generally uniform and continuous pressure on the surface area over which it travels.

In operation, for applying a laminate material on a bowling surface, a selected number of weights are placed in the box unit 35 in a uniform fashion to be distributively supported by the rollers 39 and 41 and thereby provide a desired roller pressure for each roller 39 and 41. The tractor unit 11 is then employed for initially pushing the pressure applying unit along the top surface of the laminate material to adhere such material to the bowling surface. Because of the pushing action of the tractor unit 11, which is steerable from the rear, the operator of the machine 10 does not have to walk on the laminate material before it is secured to the bowling surface. Of course, once such initial securement of the laminate material is completed, the electric motor 20 of the tractor unit 11 can be reversed so that the pressure applying unit 12 is pulled back along the bowling surface to insure that the air bubbles or other irregularities in the laminate material are eliminated.

Although the invention has been described with respect to a preferred embodiment thereof, it is to be understood that it is not to be so limited since changes and modifications can be made therein which are within the full intended scope of this invention as defined by the appended claims.

We claim:

1. In a machine for uniformly applying pressure on a relatively level surface, said machine comprising:

(a) a portable weight bearing frame, (b) at least one transversely extended frame supporting roller rotatably mounted from the bottom of said frame, (c) axle means for said roller having the ends thereof laterally projected from opposite sides of said roller, and (d) means for journaling said roller on said frame including:

(1) a pair of transversely spaced upright bracket means, each having an upright guideway with an adjacent upright surface, and a top end secured to the bottom of said frame, (2) a pair of bearing means corresponding to said bracket means for receiving the ends of said axle means, each bearing means having a body portion guidably movable in a guideway of an associated bracket means, said body portion including laterally projected flange portions positioned between said associated bracket means and said roller and formed with fulcrum portions rideable on the upright surface of said associated bracket means for pivotal movement of said bearing means with respect to said associated bracket means, and (3) yieldable pressure means coacting with said bracket means and said bearing means to oppose upward vertical movement of said bearing means.

2. In a machine for applying pressure on a flat laminate material for adhesive securement to a relatively level surface, said machine comprising:

(a) a portable weight bearing frame having a bottom portion, (b) a plurality of frame support rollers arranged in a spaced relation transversely of said frame for rolling engagement with said laminate material, (c) axle means for each roller having end portions protruded from opposite sides of the roller, (d) means for separately rotatably supporting each of said rollers including:

(1) a pair of transversely spaced upright bracket means, each having an upright guideway with an adjacent upright surface, and a top end secured to said bottom portion of the frame, (2) a pair of bearing means for receiving the end portions of said axle means, each having a body portion guidably receivable in the guideway of an associated bracket means, said body portion including flange portions positioned between said associated bracket means and said roller and formed with fulcrum portions rideable on the adjacent surface of an associated bracket means to provide for pivotal movement of said bearing means with respect to said associated bracket means, and (3) yieldable pressure means that coact with said bracket means and said bearing means to oppose upward movement of said bearing means, and (e) said rollers disposed in at least two rows, with the rollers in one row arranged in a staggered relation relative to the rollers in the other row such that the rollers in one of said rows applies a pressure on the surface areas of the laminate material located between adjacent rollers of the other of said rows.

3. In a machine for uniformly applying pressure on a relatively level surface, said machine comprising:

(a) a portable weight bearing frame, (b) at least one transversely extended frame supporting roller rotatably mounted from the bottom of said frame, (c) axle means for said roller having the ends thereof laterally projected from opposite sides of said roller, and (d) means for journaling said roller on said frame including:

(1) a pair of transversely spaced upright bracket means, each having an upright guideway with an adjacent upright surface and a top end secured to the bottom of said frame;

(2) a pair of bearing means corresponding to said bracket means for receiving the ends of said axle means, each bearing means having a body portion guidably movable in a guideway of an associated bracket means, and (3) coacting surface portions on the body portions of said bearing means and said bracket means for pivotal movement of said bearing means relative to said bracket means.

4. In a machine for uniformly applying pressure according to claim 3, said machine further comprising:

(a) a reversibly driven tractor unit having:

(1) a housing, (2) steerable wheel means for said housing including an axle member and a pair of wheels rotatably mounted thereon, (3) means mounted on said housing to steer said wheel means, and (4) means mounted on said housing to reversibly drive said wheels, and (b) coacting means to connect said frame and said tractor unit for pivotal movement of said frame relative to said tractor unit.

* * * * *